US008672169B2

(12) United States Patent
Lipson

(10) Patent No.: US 8,672,169 B2
(45) Date of Patent: Mar. 18, 2014

(54) NOVELTY CUP WITH JEWELRY

(76) Inventor: Erik Lipson, Philadelphia, PA (US)

( * ) Notice: Subject to any disclaimer, the term of this patent is extended or adjusted under 35 U.S.C. 154(b) by 1624 days.

(21) Appl. No.: 11/460,066

(22) Filed: Jul. 26, 2006

(65) Prior Publication Data

US 2007/0181589 A1 Aug. 9, 2007

Related U.S. Application Data

(60) Provisional application No. 60/702,366, filed on Jul. 26, 2005.

(51) Int. Cl.
*B65D 8/12* (2006.01)
*A47G 19/22* (2006.01)
*G09F 3/14* (2006.01)

(52) U.S. Cl.
USPC ..... 220/376; 220/709; 220/672

(58) Field of Classification Search
USPC ..... 220/376, 709, 672, 375
See application file for complete search history.

(56) References Cited

U.S. PATENT DOCUMENTS

| | | | | |
|---|---|---|---|---|
| 2,155,329 | A * | 4/1939 | Perdue | 220/375 |
| 3,297,194 | A * | 1/1967 | Caldwell et al. | 220/672 |
| 5,996,836 | A * | 12/1999 | Betras | 220/709 |
| 6,293,034 | B1 * | 9/2001 | Skapyak et al. | 40/310 |
| 7,313,929 | B2 * | 1/2008 | Lazor | 63/3 |
| 7,461,757 | B2 * | 12/2008 | Lipson | 220/705 |
| 2003/0226298 | A1 * | 12/2003 | Bjork | 40/310 |
| 2004/0245257 | A1 * | 12/2004 | Lipson | 220/709 |
| 2005/0766673 | * | 4/2005 | Oliver et al. | 63/1.11 |
| 2005/0138854 | A1 * | 6/2005 | Simmons | 40/665 |

* cited by examiner

*Primary Examiner* — Anthony Stashick
*Assistant Examiner* — James N Smalley
(74) *Attorney, Agent, or Firm* — Gifford, Krass, Sprinkle, Anderson & Citkowski, P.C.

(57) ABSTRACT

A novelty item comprises a drinking cup having a sidewall formed with a groove extending about its perimeter. A jewelry item, preferably constituting a necklace, bracelet or the like, is formed with an elastic loop and a plurality of elongated jeweled dangles each having one end fixed to the loop, at spaced points, and the other end free. The loop is dimensioned so that its unstretched length is less than the perimeter of the sidewall of the cup so that the loop may be stretched to fit over the sidewall of the cup and into the groove to retain the jewelry on the exterior of the sidewall.

9 Claims, 4 Drawing Sheets

NOVELTY CUP WITH JEWELRY

RELATED APPLICATION

This application claims priority of U.S. Provisional Patent Application Ser. No. 60/702,366 filed Jul. 26, 2005, which is incorporated herein by reference.

FIELD OF THE INVENTION

This invention relates to a decorative drinking cup having a cylindrical symmetrical shape with a groove extending around the sidewall and a jewelry item such as a necklace, bracelet or the like including a closed section formed on an elastic band which is adapted to be removably retained within the groove.

BACKGROUND OF THE INVENTION

At parties, carnivals and lice large entertainment events, it is often customary to pass out favors to the attendees, such as jewelry items, including necklaces, bracelets and the like. For example, at the Mardi Gras beaded necklaces are customarily thrown from the floats and collected by viewers of the parade. The attendees at these large entertainment events often consume beverages, particularly at an event that takes place in warm weather.

SUMMARY OF THE INVENTION

The present invention is accordingly directed toward a novelty device comprising a uniquely configured cup adapted to support and be decorated with various jewelry items such as bracelets, necklaces and the like, and to a unique form of jewelry item particularly useful with such cups.

The drinking cups of the present invention are preferably formed of plastic by blow molding or injection molding but may alternatively be formed of other materials such as metal. Like all drinking cups they have an open top at one end and a flat bottom at the other end and an intermediate cylindrical wall. The drinking cups of the present invention are formed with an inwardly directed groove extending around the perimeter of the cylindrical sidewall, preferably immediately below the open-ended lip of the cup but alternatively at other locations.

The novelty item further includes a jewelry piece that is specially designed for and complementary to the cup so that it may be attached to the cup. The jewelry item comprises an elastic thread in a closed loop configuration. The loop preferably has an unstretched length somewhat smaller than the perimeter of the cup. The elastic loop may be stretched over the outer sidewall of the cup and set in the groove where it retracts, so as to detachably lock within the groove. The elastic strand may have jewelry items such as beads or the like attached along its length, so as to form a decorative loop around the cup. In a preferred embodiment it also has a plurality of beaded or jeweled elongated dangles. These dangles extend down the sides of the loop in a free-swinging manner. They may incorporate larger jeweled items at their lower ends.

In one embodiment of the cup, which will subsequently be disclosed in detail, the cup has a contoured configuration like a traditional hurricane lamp. This includes a narrowed section, leading to a bulge, which may be preferably incorporated near the base. The straw for use with the novelty item preferably has an elongated drinking section which is transparent or translucent and it terminates in its lower end in a pair of sections which extend generally transversely to the straw. The dimensions of this extending section are such as to lock into the bulging section so as to firmly retain the straw within the cup. The two extending sections which lock in the bulge may be joined by a 180 degree bend so as to increase the resilience of the extending sections and allow them to slide through the narrow section of the cup and expand within the bulge to provide the locking action.

BRIEF DESCRIPTION OF THE DRAWING

Other objects, advantages and applications of the present invention will be made apparent by the following detailed description of several preferred embodiments. The descriptions make reference to the accompanying drawings in which.

DETAILED DESCRIPTION OF THE INVENTION

Figure 1:
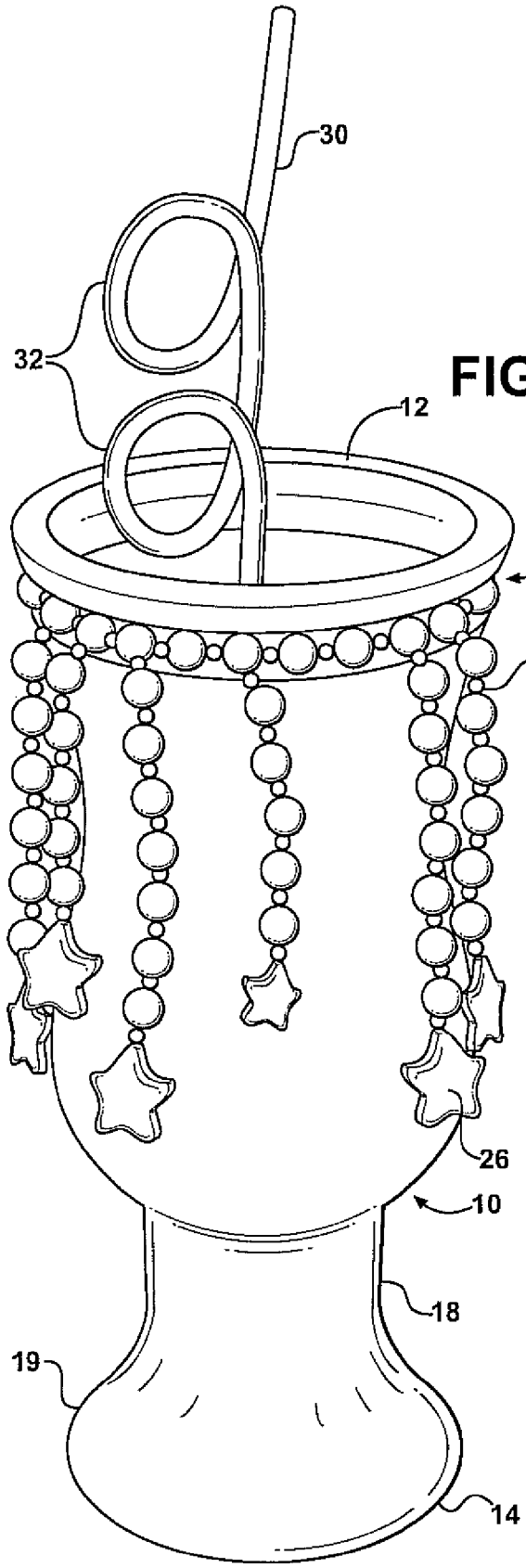
FIG. 1 is a perspective view of a preferred embodiment of the invention comprising a cup with a grooved section for retaining the elastic of a jeweled section, and a bulge at the lower end for retaining a unique straw.
Figure 2:
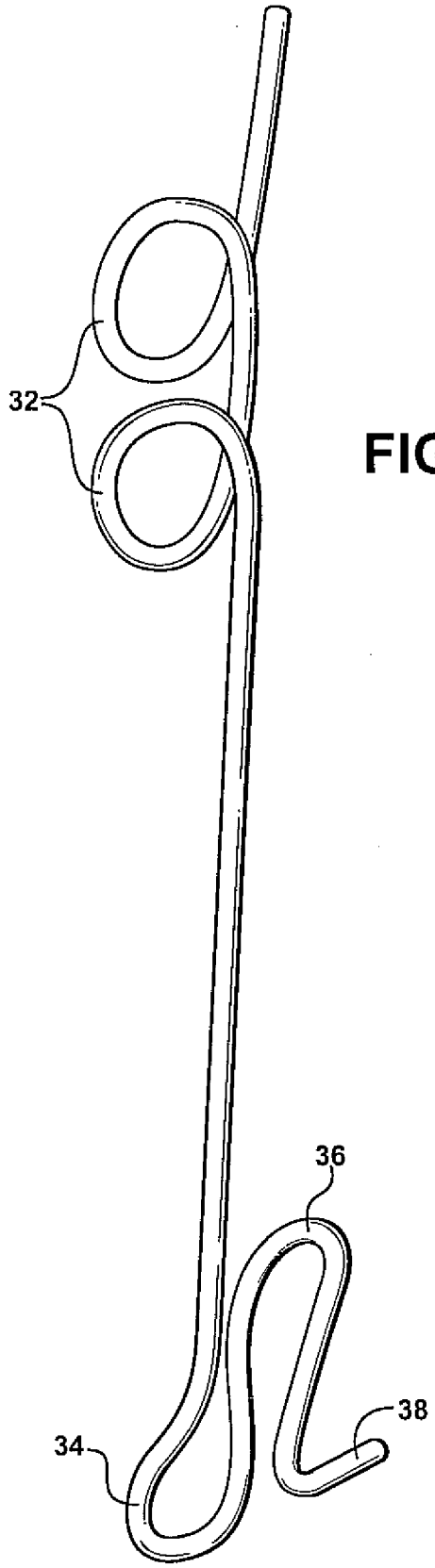
FIG. 2 is a perspective view of a straw for use with the cup of FIG. 1.
Figure 3:
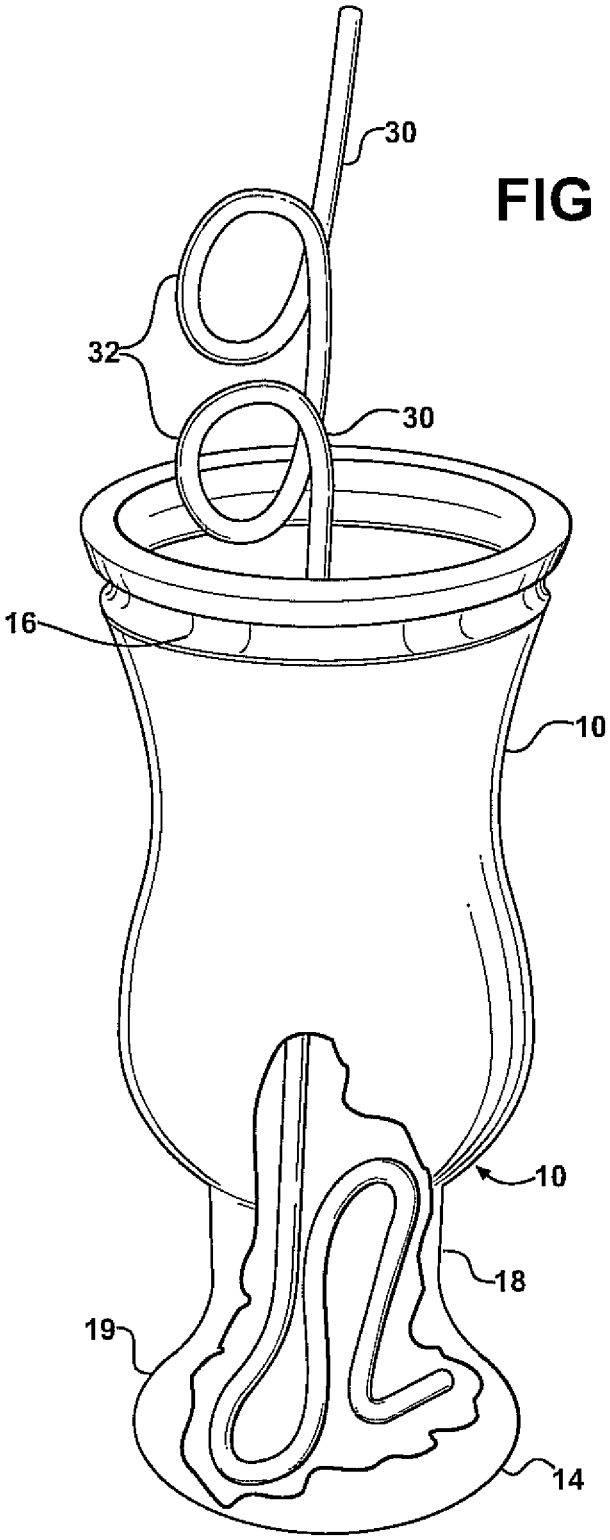
FIG. 3 is a view of the cup of FIG. 1 with the straw inserted, partially broken away to show the manner of locking of the straw in the cup bulge.

Referring to FIGS. 1-3, representing a first embodiment of my invention, a cup, generally indicated at 10, may be formed of a thermosetting plastic by blow molding or injection molding or similar processes. Alternatively it could be formed of other materials such as glass, metal or the like. It has an open drinking lip 12 at its upper end and a flat base 14 at its lower end for supporting it on a horizontal surface. The cup is preferably formed about a symmetrical central axis as a surface revolution. It includes a concave groove 16 formed adjacent to and below the lip 12 and a narrow concave neck 18 adjacent its lower end which flows out into a bulge section 19 just above the base. As shown in FIG. 3, the groove 16 is semicircular.

In FIG. 1 the cup 10 is illustrated with an attached jewelry item, generally indicated at 20, supported in the groove 16. The jewelry item includes a central loop comprising a series of beads strung on a closed loop of elastic thread. The semicircular configuration of the groove 16 restrains motion of the thread toward either the top or bottom of the cup 10. The beads are shown as alternating in size with small diameter beads between a pair of larger diameter beads. The elastic loop is large enough to allow easy insertion over the lip 12 but has an unstretched length which causes it to collapse into the groove 16 so as to firmly retain the jeweled item 12 in the groove. At spaced intervals around the loop 22, dangles 24 with emblems 26 at their lower ends are formed so that they hang down the body of the cup 10. The jeweled item may also serve as a bracelet, necklace, anklet or the like.

A transparent or translucent drinking straw 30, preferably formed of plastic, which is shown independently of the cup 10 in FIG. 2, is associated with the cup. The straw is preferably formed of a material and thickness that renders it resilient and manually deformable. The transparent or translucent nature is such that when liquid is drawn by the user through the straw the user may view the passage of the liquid through the straw. The preferred embodiment of the straw has a pair of decorative loops 32 formed near its top end to further enhance the viewing experience when liquid is drawn through the straw, or the straw can either be straight at the top or formed in a wide variety of configurations.

At its lower end, the straw has a loop 34 which extends generally laterally to the major length of the straw 30 and is adapted to engage the interior side of the bulge section 19 of the cup. The loop 34 is connected to an upwardly extending loop, which makes a 180 degree turn and extends generally parallel to the main straw section 30. It terminates in a straight section 38 extending generally in an opposite direction to the loop 34. The distance between the extending section and the far end of the loop 34 is substantially equal to the interior dimension of the bulge section 19. This allows the straw to be effectively locked into the cup 10 by engagement between the loop section, the extending section 38 and the interior of the bulge section 19 of the cup so that when empty, the cup could be lifted by lifting the upper end of the straw 30. FIG. 3 illustrates the manner of engagement between the bottom sections of the straw and the cup at the bulge 19.

While the shape of the cup 10 is reminiscent of a hurricane lamp, alternative embodiments of the invention could employ cups with a wide variety of shapes. A straight-sided cup, without a bulge 19, may be used with a conventional straw without the locking configuration. Also, the cup could be useful without any straw at all. The user could drink directly from the lip 12. Similarly, the jeweled item 20 can have a wide variety of configurations consistent with an elastic loop section.

Figure 4:
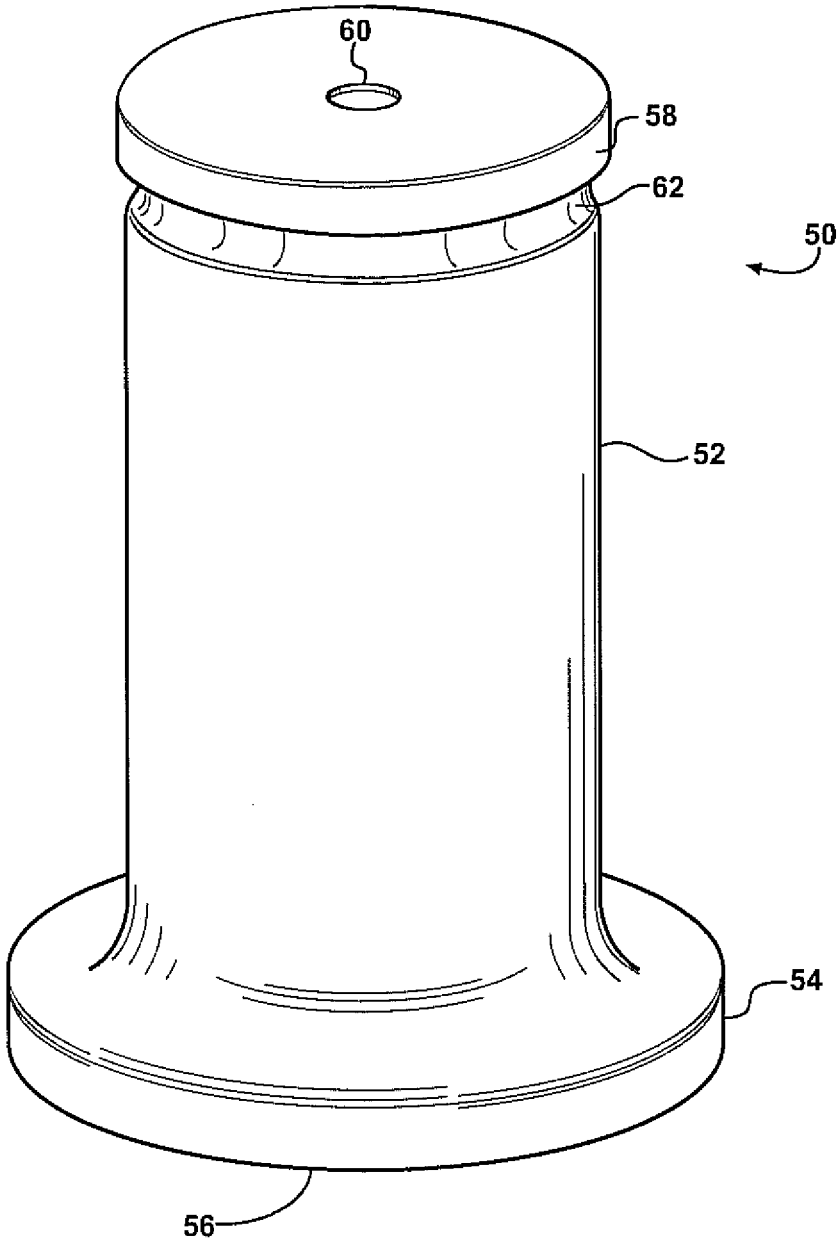
FIG. 4 is an embodiment of the cup with a cover having an aperture for supporting a drinking straw.

FIG. 4 illustrates a second embodiment of the invention, which is substantially similar to the first embodiment, but employs a cup with relatively straight sidewalls 52 and a bulge section 54 above a base 56 to engage the lower sections of the straw. The open top of the cup 50 is closed by a removable cap 58 having a central aperture 60 through which the straw may project. The cup 50 has a groove 62 formed in the sidewall 52 below the lip for retention of the elastic loop of a jewelry item like the item 20 (not shown).

Having thus described my invention, I claim:

1. A novelty item comprising:

a drinking cup having an open top at one end, a flat base at the opposite end, and a cylindrical sidewall connecting the top and the base, the sidewall having a concave, groove formed about its perimeter between the top and the base; and a jewelry item comprising an elastic loop of unstretched length less than the perimeter of the sidewall so that the elastic loop can be stretched to fit over the sidewall of the cup and fit within the groove to retain the jewelry item on the exterior of the sidewall and restrain it against motion toward the top or base of the cup, the jewelry item further comprising a series of decorative items, each having a hole adapted to receive the elastic loop, with the loop passing through the holes on each item so that the decorative items are arrayed along the length of the loop; whereby the jewelry item may be supported on the cup, in the groove, or may be removed from the cup and supported about a user's appendage as a bracelet, necklace, anklet, or the like.

2. The novelty item of claim 1 wherein the groove is formed parallel to and adjacent to the top.

3. The novelty item of claim 1 wherein the jewelry item further comprises a plurality of elongated jeweled dangles each having one end attached to the loop with the opposite end free so that the bangles extend downwardly over the sidewall of the cup when the elastic loop is fitted within the groove.

4. The novelty item of claim 1 wherein the sidewall includes an enlarged bulge section extending about its perimeter, and further comprising a drinking straw adapted to extend into the drinking cup through the open top and having a laterally extending section sized so that its opposed ends fit within the inner side of said bulge in the sidewall at radially opposed points to retain the drinking straw within the drinking cup.

5. The novelty item of claim 4 wherein the drinking straw is formed of a substantially transparent resilient material.

6. The novelty item of claim 4 wherein the bulge in the sidewall is formed directly above the base of the drinking cup.

7. The novelty item of claim 4 further comprising a cap adapted to be removably attached to the open top of the drinking cup and having an aperture therein allowing the straw to pass through.

8. The novelty item of claim 7 wherein the laterally extending section of the straw is formed at one end.

9. The novelty item of claim 4 wherein the straw contains a central section adapted to extend through the height of the cup from the top to the bottom and the laterally extending section projects in two opposed directions from one end of the drinking straw.

* * * * *